US007822617B2

(12) United States Patent
Taleb et al.

(10) Patent No.: US 7,822,617 B2
(45) Date of Patent: Oct. 26, 2010

(54) OPTIMIZED FIDELITY AND REDUCED SIGNALING IN MULTI-CHANNEL AUDIO ENCODING

(75) Inventors: Anisse Taleb, Kista (SE); Stefan Andersson, Trångsund (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 1033 days.

(21) Appl. No.: 11/358,726

(22) Filed: Feb. 22, 2006

(65) Prior Publication Data

US 2006/0195314 A1 Aug. 31, 2006

Related U.S. Application Data

(60) Provisional application No. 60/654,956, filed on Feb. 23, 2005.

(51) Int. Cl.
*G10L 19/00* (2006.01)

(52) U.S. Cl. ..... 704/501; 704/200.1; 704/500

(58) Field of Classification Search ..... 704/200.1, 704/500, 501
See application file for complete search history.

(56) References Cited

U.S. PATENT DOCUMENTS 5,285,498 A 2/1994 Johnston
5,394,473 A * 2/1995 Davidson ..... 704/200.1
5,434,948 A 7/1995 Holt et al.
5,694,332 A 12/1997 Maturi
5,812,971 A 9/1998 Herre
5,956,674 A 9/1999 Smyth et al.
6,012,031 A * 1/2000 Oliver et al. ..... 704/500
6,446,037 B1 9/2002 Fielder et al.
6,487,535 B1 11/2002 Smyth et al.

(Continued)

FOREIGN PATENT DOCUMENTS

EP 0497413 8/1992

(Continued)

OTHER PUBLICATIONS

International Search Report and Written Opinion mailed Jun. 30, 2006 in corresponding PCT application No. PCT/SE2006/000235.

(Continued)

*Primary Examiner*—Richemond Dorvil
*Assistant Examiner*—Douglas C Godbold
(74) *Attorney, Agent, or Firm*—Nixon & Vanderhye P.C.

(57) ABSTRACT

The invention provides an efficient technique for encoding a multi-channel audio signal. The invention relies on the principle of encoding (S1) a signal representation of one or more of the multiple channels in a first encoding process, and encoding another signal representation of one or more channels in a second, filter-based encoding process. A basic idea according to the invention is to select (S2), for the second encoding process, a combination of i) frame division configuration of an overall encoding frame into a set of sub-frames, and ii) filter length for each sub-frame, according to a predetermined criterion. The second signal representation is then encoded (S3) in each sub-frame of the overall encoding frame according to the selected combination. The possibility to select frame division configuration and at the same time adjust the filter length for each sub-frame provides added degrees of freedom, and generally results in improved performance.

27 Claims, 11 Drawing Sheets

U.S. PATENT DOCUMENTS

| | | | | |
|---|---|---|---|---|
| 6,591,241 | B1 | 7/2003 | Absar et al. | |
| 2003/0061055 | A1 | 3/2003 | Taori et al. | |
| 2003/0115041 | A1 | 6/2003 | Chen et al. | |
| 2003/0115052 | A1 | 6/2003 | Chen et al. | |
| 2004/0267543 | A1* | 12/2004 | Ojanpera | 704/500 |
| 2005/0165611 | A1* | 7/2005 | Mehrotra et al. | 704/500 |

FOREIGN PATENT DOCUMENTS

| | | | |
|---|---|---|---|
| EP | 0965123 | | 1/2003 |
| EP | 1 391 880 | A2 | 2/2004 |
| JP | 11-032399 | | 2/1999 |
| JP | 2001-184090 | | 7/2001 |
| JP | 2001-255899 | | 9/2001 |
| JP | 2002-132295 | | 5/2002 |
| JP | 2003-345398 | | 12/2003 |
| WO | 03/090206 | | 10/2003 |
| WO | 2005/001813 | A1 | 1/2005 |

OTHER PUBLICATIONS

3GPP Tech. Spec. TS 26.290, V6.1.0, 3rd Generation Partnership Project; Tech. spec. Group Service and System Aspects; Audio Codec Processing Functions; Extended Adaptive Multi-Rate—Wideband (AMR-WB+) Codec; Transcoding Functions (Release 6), Dec. 2004.

C. Faller and F. Baumgarte; "Binaural Cue Coding Applied to Stereo and Multi-Channel Audio Compression;" AES 112th Convention Paper 5574; Munich, Germany; May 10-13, 2002.

B. Edler, C. Faller, and G. Schuller; "Perceptual Audio Coding Using a Time-Varying Linear Pre- and Post-Filter;" AES 109th Convention; Los Angeles; Sep. 22-25, 2000.

B. Bdler and G. Schuller; Audio Coding Using a Psychoacoustic Pre- and Post-Filter; pp. 881-884, 2000.

D. Bauer and D. Seltzer; "Statistical Properties of High Quality Stereo Signals in the Time Domain;" pp. 2045-2048, 1989.

Shyh-Shiaw Kuo and James D. Johnston; "A Study of Why Cross Channel Prediction is Not Applicable to Perceptual Audio Coding;" IEEE Signal Processing Letters, vol. 8, No. 9, Sep. 2001; pp. 245-247.

International Search Report and Written Opinion mailed Mar. 17, 2005 in corresponding PCT Application PCT/SE2004/001867.

Related U.S. Appl. No. 11/011,764, filed Dec. 15, 2004; Taleb et al.

Christof Faller and Frank Baumgarte; "Efficient Representation of Spatial Audio Using Perceptual Parametrization;" Applications of Signal Processing to Audio and Acoustics; 2001 IEEE Workshop on Publication date Oct. 21-24, 2001; pp. W2001-1 through W2001-4.

International Search Report and Written Opinion mailed Mar. 17, 2005 in corresponding PCT Application PCT/SE2004/001907.

Japanese official action, dated May 7, 2008 in corresponding Japanese Application No. 2006-518596.

Summary of the Japanese official action, dated May 7, 2008 in corresponding Japanese Application No. 2006-518596.

Canadian official action, Jun. 17, 2008, in corresponding Canadian Application No. 2,527,971.

L.R. Rabiner and R.W. Schafer, "Digital Processing of Speech Signals", Chapter 4: "Time-Domain Methods for Speech Processing", Upper Saddle River, New Jersey: Prentice Hall, Inc., 1978, pp. 116-130.

European Search Report dated Jun. 29, 2010 (5 pages).

* cited by examiner

OPTIMIZED FIDELITY AND REDUCED SIGNALING IN MULTI-CHANNEL AUDIO ENCODING

This application claims the benefit and priority of U.S. provisional application 60/654,956 filed Feb. 23, 2005, and PCT Application PCT/SE2005/002033, both of which are incorporated by reference herein.

TECHNICAL FIELD

The present disclosure generally relates to audio encoding and decoding techniques, and more particularly to multi-channel audio encoding such as stereo coding.

BACKGROUND

There is a high market need to transmit and store audio signals at low bit rates while maintaining high audio quality. Particularly, in cases where transmission resources or storage is limited low bit rate operation is an essential cost factor. This is typically the case, for example, in streaming and messaging applications in mobile communication systems such as GSM, UMTS, or CDMA.

A general example of an audio transmission system using multi-channel coding and decoding is schematically illustrated in FIG. 1. The overall system basically comprises a multi-channel audio encoder 100 and a transmission module 10 on the transmitting side, and a receiving module 20 and a multi-channel audio decoder 200 on the receiving side.

The simplest way of stereophonic or multi-channel coding of audio signals is to encode the signals of the different channels separately as individual and independent signals, as illustrated in FIG. 2. However, this means that the redundancy among the plurality of channels is not removed, and that the bit-rate requirement will be proportional to the number of channels.

Another basic way used in stereo FM radio transmission and which ensures compatibility with legacy mono radio receivers is to transmit a sum and a difference signal of the two involved channels.

State-of-the art audio codecs such as MPEG-1/2 Layer III and MPEG-2/4 AAC make use of so-called joint stereo coding. According to this technique, the signals of the different channels are processed jointly rather than separately and individually. The two most commonly used joint stereo coding techniques are known as 'Mid/Side' (M/S) Stereo and intensity stereo coding which usually are applied on sub-bands of the stereo or multi-channel signals to be encoded.

M/S stereo coding is similar to the described procedure in stereo FM radio, in a sense that it encodes and transmits the sum and difference signals of the channel sub-bands and thereby exploits redundancy between the channel sub-bands. The structure and operation of a coder based on M/S stereo coding is described, e.g. in reference [1].

Intensity stereo on the other hand is able to make use of stereo irrelevancy. It transmits the joint intensity of the channels (of the different sub-bands) along with some location information indicating how the intensity is distributed among the channels. Intensity stereo does only provide spectral magnitude information of the channels, while phase information is not conveyed. For this reason and since temporal inter-channel information (more specifically the inter-channel time difference) is of major psycho-acoustical relevancy particularly at lower frequencies, intensity stereo can only be used at high frequencies above e.g. 2 kHz. An intensity stereo coding method is described, e.g. in reference [2].

A recently developed stereo coding method called Binaural Cue Coding (BCC) is described in reference [3]. This method is a parametric multi-channel audio coding method. The basic principle of this kind of parametric coding technique is that at the encoding side the input signals from N channels are combined to one mono signal. The mono signal is audio encoded using any conventional monophonic audio codec. In parallel, parameters are derived from the channel signals, which describe the multi-channel image. The parameters are encoded and transmitted to the decoder, along with the audio bit stream. The decoder first decodes the mono signal and then regenerates the channel signals based on the parametric description of the multi-channel image.

The principle of the Binaural Cue Coding (BCC) method is that it transmits the encoded mono signal and so-called BCC parameters. The BCC parameters comprise coded inter-channel level differences and inter-channel time differences for sub-bands of the original multi-channel input signal. The decoder regenerates the different channel signals by applying sub-band-wise level and phase and/or delay adjustments of the mono signal based on the BCC parameters. The advantage over e.g. M/S or intensity stereo is that stereo information comprising temporal inter-channel information is transmitted at much lower bit rates. However, BCC is computationally demanding and generally not perceptually optimized.

Another technique, described in reference [4] uses the same principle of encoding of the mono signal and so-called side information. In this case, the side information consists of predictor filters and optionally a residual signal. The predictor filters, estimated by an LMS algorithm, when applied to the mono signal allow the prediction of the multi-channel audio signals. With this technique one is able to reach very low bit rate encoding of multi-channel audio sources, however at the expense of a quality drop.

The basic principles of such parametric stereo coding are illustrated in FIG. 3, which displays a layout of a stereo codec, comprising a down-mixing module 120, a core mono codec 130, 230 and a parametric stereo side information encoder/decoder 140, 240. The down-mixing transforms the multi-channel (in this case stereo) signal into a mono signal. The objective of the parametric stereo codec is to reproduce a stereo signal at the decoder given the reconstructed mono signal and additional stereo parameters.

Finally, for completeness, a technique is to be mentioned that is used in 3D audio. This technique synthesizes the right and left channel signals by filtering sound source signals with so-called head-related filters. However, this technique requires the different sound source signals to be separated and can thus not generally be applied for stereo or multi-channel coding.

SUMMARY

One or more embodiments of the present invention overcomes these and other drawbacks of the prior art arrangements.

It is a general object of the embodiment(s) to provide high multi-channel audio quality at low bit rates.

In particular it is desirable to provide an efficient encoding process that is capable of accurately representing stereophonic or multi-channel information using a relatively low number of encoding bits. For stereo coding, for example, it is important that the dynamics of the stereo image are well represented so that the quality of stereo signal reconstruction is enhanced.

It is also an object of the embodiment(s) to make efficient use of the available bit budget and optimize the required signaling.

It is a particular object of the embodiment(s) to provide a method and apparatus for encoding a multi-channel audio signal.

Another particular object of the embodiments is to provide a method and apparatus for decoding an encoded multi-channel audio signal.

Yet another particular object of the embodiment(s) is to provide an improved audio transmission system.

Today, there are no standardized codecs available providing high stereophonic or multi-channel audio quality at bit rates which are economically interesting for use in e.g. mobile communication systems. What is possible with available codecs is monophonic transmission and/or storage of the audio signals. To some extent also stereophonic transmission or storage is available, but bit rate limitations usually require limiting the stereo representation quite drastically.

The embodiment(s) overcome these problems by proposing a non-limiting solution, which allows to separate stereophonic or multi-channel information from the audio signal and to accurately represent it in the best possible manner. The embodiment(d) rely on the basic principle of encoding a first signal representation of one or more of the multiple channels in a first encoding process, and encoding a second signal representation of one or more of the multiple channels in a second, filter-based encoding process. A basic idea according to a non-limiting aspect is to select, for the second encoding process, a combination of i) frame division configuration of an overall encoding frame into a set of sub-frames, and ii) filter length for each sub-frame, according to a predetermined criterion. The second signal representation is then encoded in each of the sub-frames of the selected set of sub-frames in accordance with the selected combination.

For variable frame lengths, an encoding frame can generally be divided into a number of sub-frames according to various frame division configurations. The sub-frames may have different sizes, but the sum of the lengths of the sub-frames of any given frame division configuration is typically equal to the length of the overall encoding frame. The possibility to select frame division configuration and at the same time adjust the filter length for each sub-frame provides added degrees of freedom, and generally results in improved performance. The predetermined criterion is preferably based on optimization of a measure representative of the performance of the second encoding process over an entire encoding frame.

The second encoding process or a controller associated therewith will generate output data representative of the selected frame division configuration, and filter length for each sub-frame of the selected frame division configuration. This output data is transmitted from the encoding side to the decoding side to enable correct decoding of encoded information. Although the overall performance will be improved significantly by selection of an appropriate combination of frame division configuration and filter lengths, the signaling requirements for transmission from the encoding side to the decoding side in an audio transmission system will apparently increase. In a particular, exemplary non-limiting embodiment, it may therefore be desirable to associate each sub-frame of a certain length with a predefined filter length. Usually long filters are assigned to long frames and short filters to short frames.

In other words, the predetermined criterion thus includes the requirement that the filter length, for each sub frame, is selected in dependence on the length of the sub-frame so that an indication of frame division configuration of an encoding frame into a set of sub-frames at the same time provides an indication of selected filter dimension for each sub-frame. In this way, the required signaling to the decoding side may be reduced.

In a non-limiting embodiment, the predetermined criterion is based on optimization of a measure representative of the performance of said second encoding process over an entire encoding frame under the requirement that the filter length, for each sub frame, is controlled by the length of the sub-frame.

On the decoding side, a decoder receives information representative of which frame division configuration of an overall encoding frame into a set of sub-frames, and filter length for each sub-frame, that have been used in the corresponding second encoding process. This information is used for interpreting the second signal reconstruction data in the second decoding process for the purpose of correctly decoding the second signal representation. As previously mentioned, this information preferably includes data that while indicating frame division configuration of an encoding frame into a set of sub-frames at the same time provides an indication of selected filter dimension for each sub-frame.

If the first encoding process uses so-called variable frame length processing with a frame division configuration of an overall encoding frame into a set of sub-frames, it may be useful to use the same frame division configuration also for the second encoding process. In this way, it is sufficient to signal information representative of the frame division configuration for only one of the encoding processes.

The encoding and associated control of frame division configuration and filter lengths are preferably performed on a frame-by-frame basis. Further, the control system preferably operates based on the inter-channel correlation characteristics of the multi-channel audio signal.

For example, the first encoding process may be a main encoding process and the first signal representation may be a main signal representation. The second encoding process may for example be an auxiliary/side signal process, and the second signal representation may then be a side signal representation such as a stereo side signal. In such a case, the second encoding process normally includes adaptive inter-channel prediction (ICP) for prediction of the second signal representation based on the first and second signal representations, using variable frame length processing combined with adjustable ICP filter length. An advantage of using such a scheme is that the dynamics of the stereo or multi-channel image are well represented. The selection of frame division configuration and associated filter lengths is preferably based on estimated performance of the second encoding process in general, and the ICP filter in particular.

Although the aspect is mainly described to the case when the first encoding process is a main encoding process and the second encoding process is an auxiliary encoding process, it should be understood that another non-limiting aspect the invention can also be applied to the case when the first encoding process is an auxiliary encoding process and the second encoding process is a main encoding process. It may even be the case that the control of frame division configuration and associated filter lengths is effectuated for both the first encoding process and the second encoding process.

The embodiment(s) of the following non-exhaustive advantages:

Improved multi-channel audio encoding/decoding.

Improved audio transmission system.

Increased multi-channel audio reconstruction quality.

High multi-channel audio quality at relatively low bit rates.

High fidelity with optimized signaling.

Good representation of the dynamics of the stereo image

Enhanced quality of stereo signal reconstruction.

Other advantages offered by the invention will be appreciated when reading the below description of embodiments of the invention.

BRIEF DESCRIPTION OF THE DRAWINGS

The invention, together with further objects and advantages thereof, will be best understood by reference to the following description taken together with the accompanying drawings, in which.

DETAILED DESCRIPTION

Figure 1:
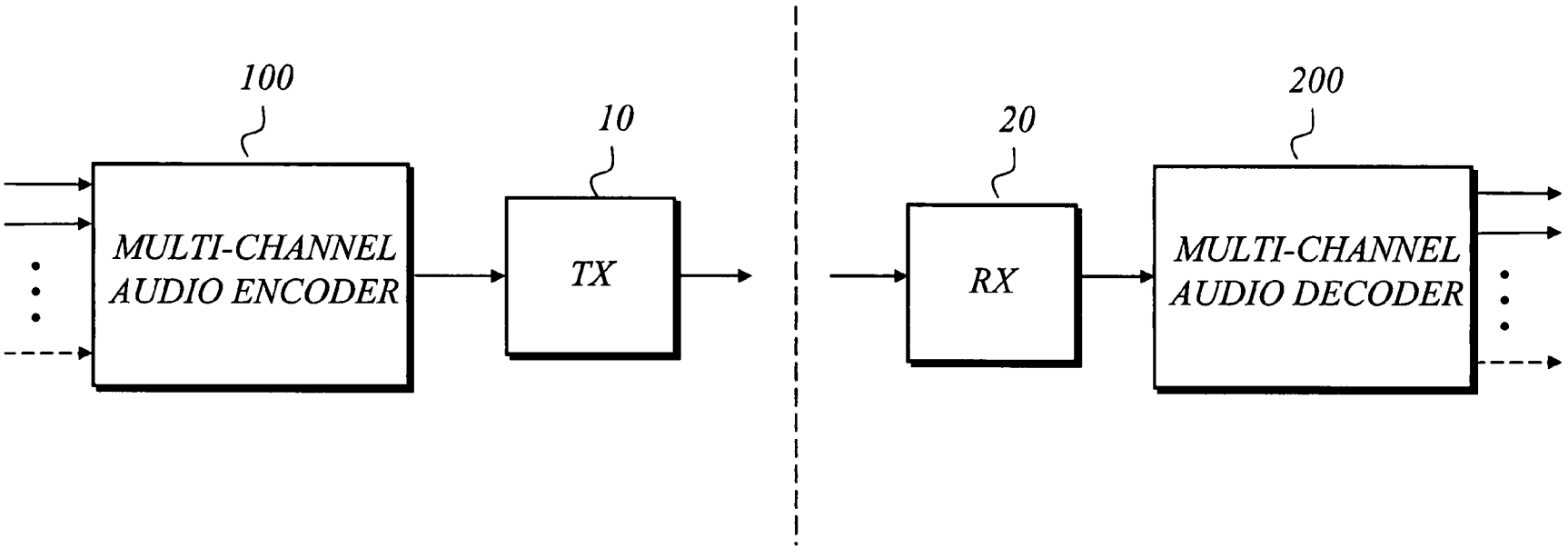
Fig. 1 (Prior art)
FIG. 1 is a schematic block diagram illustrating a general example of an audio transmission system using multi-channel coding and decoding.
Figure 2:
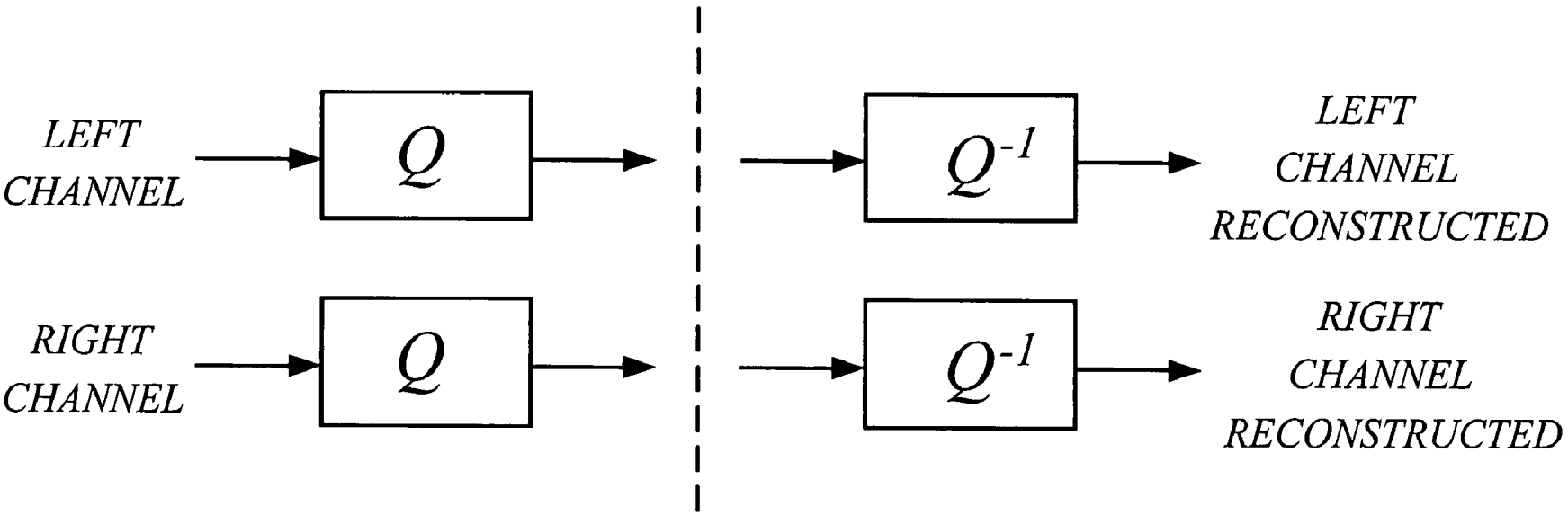
Fig. 2 (Prior art)
FIG. 2 is a schematic diagram illustrating how signals of different channels are encoded separately as individual and independent signals.
Figure 3:
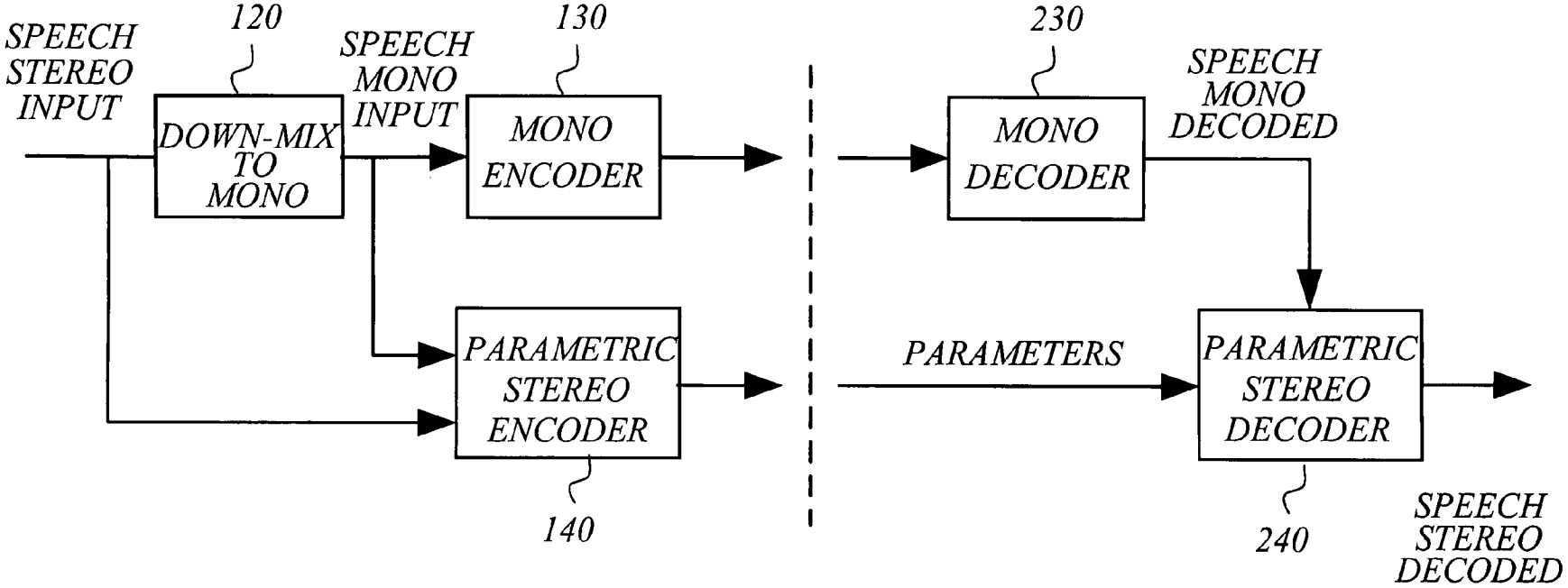
Fig. 3 (Prior art)
FIG. 3 is a schematic block diagram illustrating the basic principles of parametric stereo coding.

Throughout the drawings, the same reference characters will be used for corresponding or similar elements.

An aspect of the invention relates to multi-channel encoding/decoding techniques in audio applications, and particularly to stereo encoding/decoding in audio transmission systems and/or for audio storage. Examples of possible audio applications include phone conference systems, stereophonic audio transmission in mobile communication systems, various systems for supplying audio services, and multi-channel home cinema systems.

For a better understanding, it may be useful to begin with a brief overview and analysis of problems with existing technology. Today, there are no standardized codecs available providing high stereophonic or multi-channel audio quality at bit rates which are economically interesting for use in e.g. mobile communication systems, as mentioned previously. What is possible with available codecs is monophonic transmission and/or storage of the audio signals. To some extent also stereophonic transmission or storage is available, but bit rate limitations usually require limiting the stereo representation quite drastically.

The problem with the state-of-the-art multi-channel coding techniques is that they require high bit rates in order to provide good quality. Intensity stereo, if applied at low bit rates as low as e.g. only a few kbps suffers from the fact that it does not provide any temporal inter-channel information. As this information is perceptually important for low frequencies below e.g. 2 kHz, it is unable to provide a stereo impression at such low frequencies.

BCC on the other hand is able to reproduce the stereo or multi-channel image even at low frequencies at low bit rates of e.g. 3 kbps since it also transmits temporal inter-channel information. However, this technique requires computationally demanding time-frequency transforms on each of the channels both at the encoder and the decoder. Moreover, BCC does not attempt to find a mapping from the transmitted mono signal to the channel signals in a sense that their perceptual differences to the original channel signals are minimized.

The LMS technique, also referred to as inter-channel prediction (ICP), for multi-channel encoding, see [4], allows lower bit rates by omitting the transmission of the residual signal. To derive the channel reconstruction filter, an unconstrained error minimization procedure calculates the filter such that its output signal matches best the target signal. In order to compute the filter, several error measures may be used. The mean square error or the weighted mean square error are well known and are computationally cheap to implement.

One could say that in general, most of the state-of-the-art methods have been developed for coding of high-fidelity audio signals or pure speech. In speech coding, where the signal energy is concentrated in the lower frequency regions, sub-band coding is rarely used. Although methods as BCC allow for low bit-rate stereo speech, the sub-band transform coding processing increases both complexity and delay.

Research concludes that even though ICP coding techniques do not provide good results for high-quality stereo signals, for stereo signals with energy concentrated in the lower frequencies, redundancy reduction is possible [5]. The whitening effects of the ICP filtering increase the energy in the upper frequency regions, resulting in a net coding loss for perceptual transform coders. These results have been confirmed in [6] and [7] where quality enhancements have been reported only for speech signals.

Figure 4:
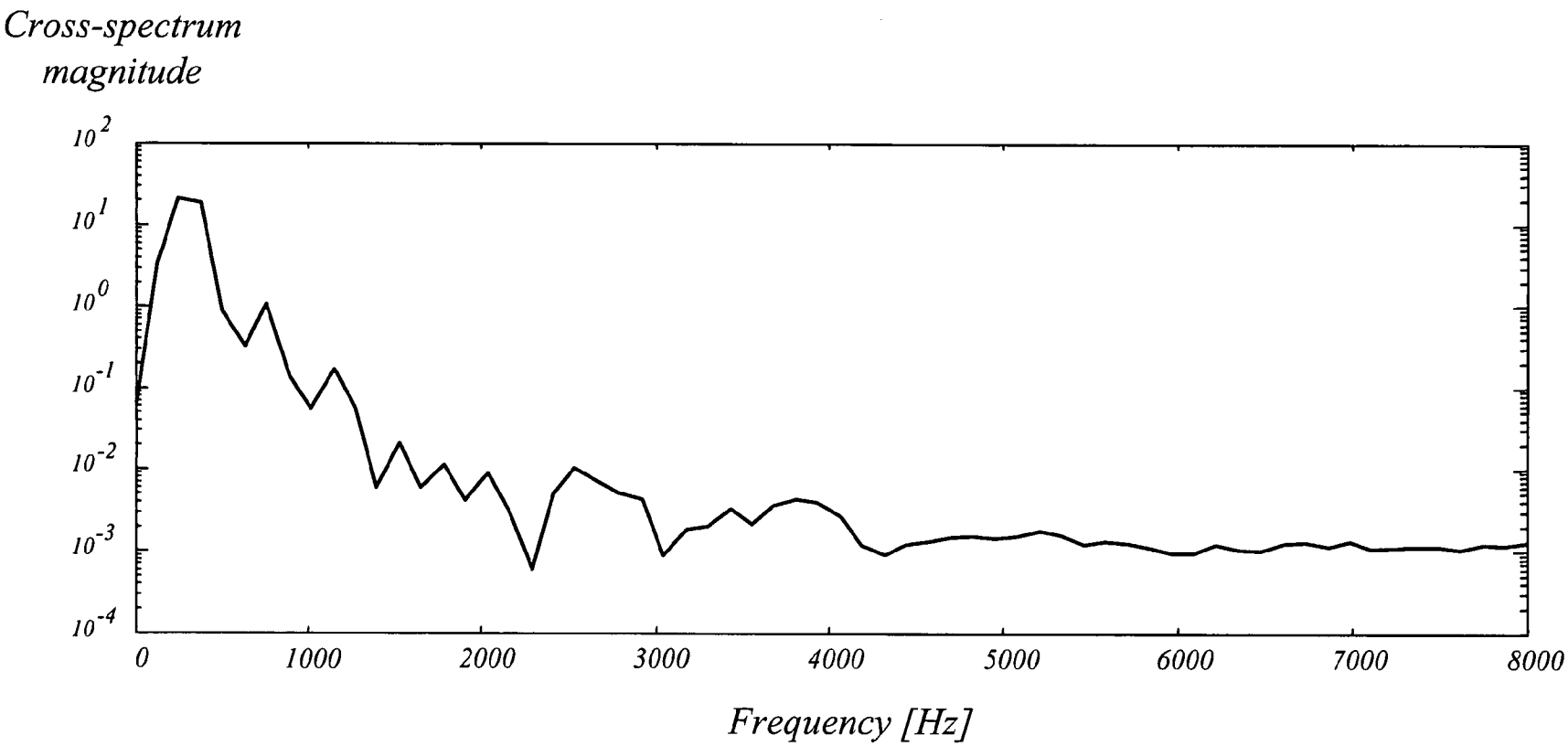
FIG. 4 is a diagram illustrating the cross spectrum of mono and side signals.

The accuracy of the ICP reconstructed signal is governed by the present inter-channel correlations. Bauer et al. [8] did not find any linear relationship between left and right channels in audio signals. However, as can be seen from the cross spectrum of the mono and side signals in FIG. 4, strong inter-channel correlation is found in the lower frequency regions (0-2000 Hz) for speech signals. In the event of low inter-channel correlations, the ICP filter, as means for stereo coding, will produce a poor estimate of the target signal.

Figure 5:
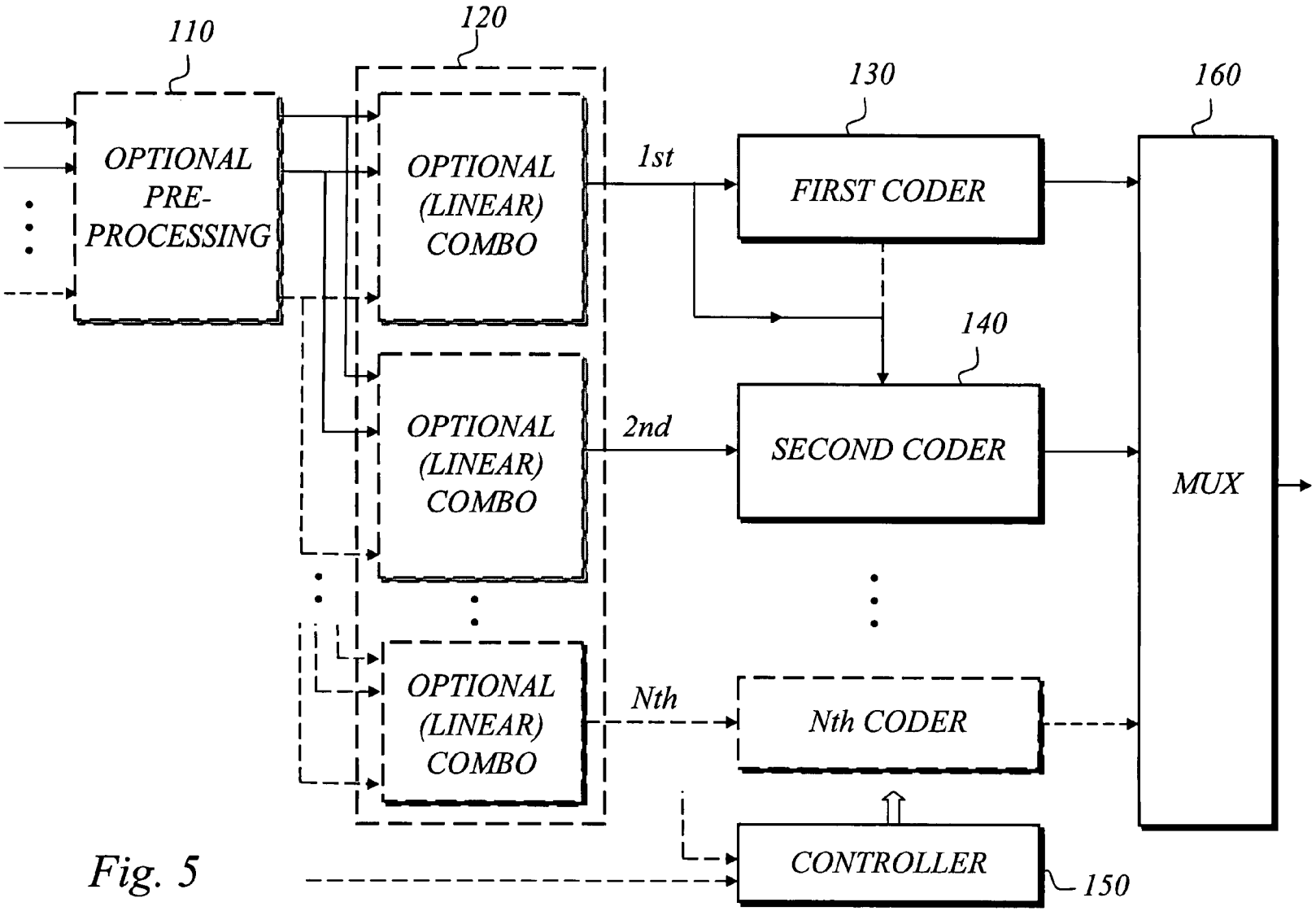
FIG. 5 is a schematic block diagram of a multi-channel encoder according to an exemplary preferred non-limiting embodiment of the invention.

FIG. 5 is a schematic block diagram of a multi-channel encoder according to an exemplary preferred embodiment of the invention. The multi-channel encoder basically comprises an optional pre-processing unit 110, an optional (linear) combination unit 120, a number of encoders 130, 140, a controller 150 and an optional multiplexor (MUX) unit 160. The number N of encoders is equal to or greater than 2, and includes a first encoder 130 and a second encoder 140, and possibly further encoders.

In general, the embodiment considers a multi-channel or polyphonic signal. The initial multi-channel input signal can be provided from an audio signal storage (not shown) or "live", e.g. from a set of microphones (not shown). The audio signals are normally digitized, if not already in digital form, before entering the multi-channel encoder. The multi-channel signal may be provided to the optional pre-processing unit 110 as well as an optional signal combination unit 120 for generating a number N of signal representations, such as for example a main signal representation and an auxiliary signal representation, and possibly further signal representations.

The multi-channel or polyphonic signal may be provided to the optional pre-processing unit 110, where different signal conditioning procedures may be performed.

The (optionally pre-processed) signals may be provided to an optional signal combination unit 120, which includes a number of combination modules for performing different signal combination procedures, such as linear combinations of the input signals to produce at least a first signal and a second signal. For example, the first encoding process may be a main encoding process and the first signal representation may be a main signal representation. The second encoding process may for example be an auxiliary (side) signal process, and the second signal representation may then be an auxiliary (side) signal representation such as a stereo side signal. In traditional stereo coding, for example, the L and R channels are summed, and the sum signal is divided by a factor of two in order to provide a traditional mono signal as the first (main) signal. The L and R channels may also be subtracted, and the difference signal is divided by a factor of two to provide a traditional side signal as the second signal. Any type of linear combination, or any other type of signal combination for that matter, may be performed in the signal combination unit with weighted contributions from at least part of the various channels. As understood, the signal combination is not limited to two channels but may of course involve multiple channels. It is also possible to generate more than two signals, as indicated in FIG. 5. It is even possible to use one of the input channels directly as a first signal, and another one of the input channels directly as a second signal. For stereo coding, for example, this means that the L channel may be used as main signal and the R channel may be used as side signal, or vice versa. A multitude of other variations also exist.

A first signal representation is provided to the first encoder 130, which encodes the first signal according to any suitable encoding principle. A second signal representation is provided to the second encoder 140 for encoding the second signal. If more than two encoders are used, each additional signal representation is normally encoded in a respective encoder.

By way of example, the first encoder may be a main encoder, and the second encoder may be a side encoder. In such a case, the second side encoder 140 may for example include an adaptive inter-channel prediction (ICP) stage for generating signal reconstruction data based on the first signal representation and the second signal representation. The first (main) signal representation may equivalently be deduced from the signal encoding parameters generated by the first encoder 130, as indicated by the dashed line from the first encoder.

The overall multi-channel encoder also comprises a controller 150, which is configured to provide added degrees of freedom for optimizing the encoding performance. In accordance with a preferred embodiment, the control system is configure to select, for a considered encoder, a combination of frame division configuration of an overall encoding frame into a set of sub-frames, and filter length for each sub-frame, according to a predetermined criterion. The corresponding signal representation is then encoded in each of the sub-frames of the selected set of sub-frames in accordance with the selected combination. The control system, which may be realized as a separate controller 150 or integrated in the considered encoder, gives the appropriate control commands to the encoder.

The possibility to select frame division configuration and at the same time adjust the filter length for each sub-frame provides added degrees of freedom, and generally results in improved performance. The predetermined criterion is preferably based on optimization of a measure representative of the performance of the second encoding process over an entire encoding frame.

The output signals of the various encoders, and frame division and filter length information from the controller 150, are preferably multiplexed into a single transmission (or storage) signal in the multiplexer unit 160. However, alternatively, the output signals may be transmitted (or stored) separately.

So called signal-adaptive optimized frame processing with variable sized sub-frames provides a higher degree of freedom to optimize the performance measure. Simulations have also shown that some audio frames benefit from using longer filters, whereas for other frames the performance increase is not proportional to the number of used filter coefficients.

For variable frame lengths, an encoding frame can generally be divided into a number of sub-frames according to various frame division configurations. The sub-frames may have different sizes, but the sum of the lengths of the sub-frames of any given frame division configuration is normally equal to the length of the overall encoding frame.

As described in our co-pending U.S. patent application Ser. No. 11/011,765, which is incorporated herein as an example by this reference, and the corresponding International Application PCT/SE2004/001867, a number of encoding schemes is provided, where each encoding scheme is characterized by or associated with a respective set of sub-frames together constituting an overall encoding frame (also referred to as a master frame). A particular encoding scheme is selected, preferably at least to a part dependent on the signal content of the signal to be encoded, and then the signal is encoded in each of the sub-frames of the selected set of sub-frames separately.

In general, encoding is typically performed in one frame at a time, and each frame normally comprises audio samples within a pre-defined time period. The division of the samples into frames will in any case introduce some discontinuities at the frame borders. Shifting sounds will give shifting encoding parameters, changing basically at each frame border. This will give rise to perceptible errors. One way to compensate somewhat for this is to base the encoding, not only on the samples that are to be encoded, but also on samples in the absolute vicinity of the frame. In such a way, there will be a softer transfer between the different frames. As an alternative, or complement, interpolation techniques are sometimes also utilized for reducing perception artifacts caused by frame borders. However, all such procedures require large additional computational resources, and for certain specific encoding techniques, it might also be difficult to provide in with any resources.

In this view, it is beneficial to utilize as long frames as possible, since the number of frame borders will be small. Also the coding efficiency typically becomes high and the necessary transmission bit-rate will typically be minimized. However, long frames give problems with pre-echo artifacts and ghost-like sounds.

By instead utilizing shorter frames, anyone skilled in the art realizes that the coding efficiency may be decreased, the transmission bit-rate may have to be higher and the problems with frame border artifacts will increase. However, shorter frames suffer less from e.g. other perception artifacts, such as ghost-like sounds and pre-echoing. In order to be able to minimize the coding error as much as possible, one should use an as short frame length as possible.

Thus, there seems to be conflicting requirements on the length of the frames. Therefore, it is beneficial for the audio perception to use a frame length that is dependent on the present signal content of the signal to be encoded. Since the influence of different frame lengths on the audio perception will differ depending on the nature of the sound to be encoded, an improvement can be obtained by letting the nature of the signal itself affect the frame length that is used. In particular, this procedure has turned out to be advantageous for side signal encoding.

Due to small temporal variations, it may e.g. in some cases be beneficial to encode the side signal with use of relatively long frames. This may be the case with recordings with a great amount of diffuse sound field such as concert recordings. In other cases, such as stereo speech conversation, short frames are preferable.

For example, the lengths of the sub-frames used could be selected according to:

$$l_{sf}=l_f/2^n,$$

where $l_{sf}$ are the lengths of the sub-frames, $l_f$ is the length of the overall encoding frame and n is an integer. However, it should be understood that this is merely an example. Any frame lengths will be possible to use as long as the total length of the set of sub-frames is kept constant.

The decision on which frame length to use can typically be performed in two basic ways: closed loop decision or open loop decision.

When a closed loop decision is used, the input signal is typically encoded by all available encoding schemes. Preferably, all possible combinations of frame lengths are tested and the encoding scheme with an associated set of sub-frames that gives the best objective quality, e.g. signal-to-noise ratio or a weighted signal-to-noise ratio, is selected.

Alternatively, the frame length decision is an open loop decision, based on the statistics of the signal. In other words, the spectral characteristics of the (side) signal will be used as a base for deciding which encoding scheme that is going to be used. As before, different encoding schemes characterized by different sets of sub-frames are available. However, in this embodiment, the input (side) signal is first analyzed and then a suitable encoding scheme is selected and utilized.

The advantage with an open loop decision is that only one actual encoding has to be performed. The disadvantage is, however, that the analysis of the signal characteristics may be very complicated indeed and it may be difficult to predict possible behaviors in advance.

By using closed loop selection, encoding schemes may be exchanged without making any changes in the rest of the implementation. On the other hand, if many encoding schemes are to be investigated, the computational requirements will be high.

The benefit with such a variable frame length coding for the input (side) signal is that one can select between a fine temporal resolution and coarse frequency resolution on one side and coarse temporal resolution and fine frequency resolution on the other. The above embodiments will preserve the multi-channel or stereo image in the best possible manner.

There are also some requirements on the actual encoding utilized in the different encoding schemes. In particular when the closed loop selection is used, the computational resources to perform a number of more or less simultaneous encoding have to be large. The more complicated the encoding process is, the more computational power is needed. Furthermore, a low bit rate at transmission is also to prefer.

The Variable Length Optimized Frame Processing may take as input a large "master-frame" and given a certain number of frame division configurations, selects the best frame division configuration with respect to a given distortion measure, e.g. MSE or weighted MSE.

Figure 6:
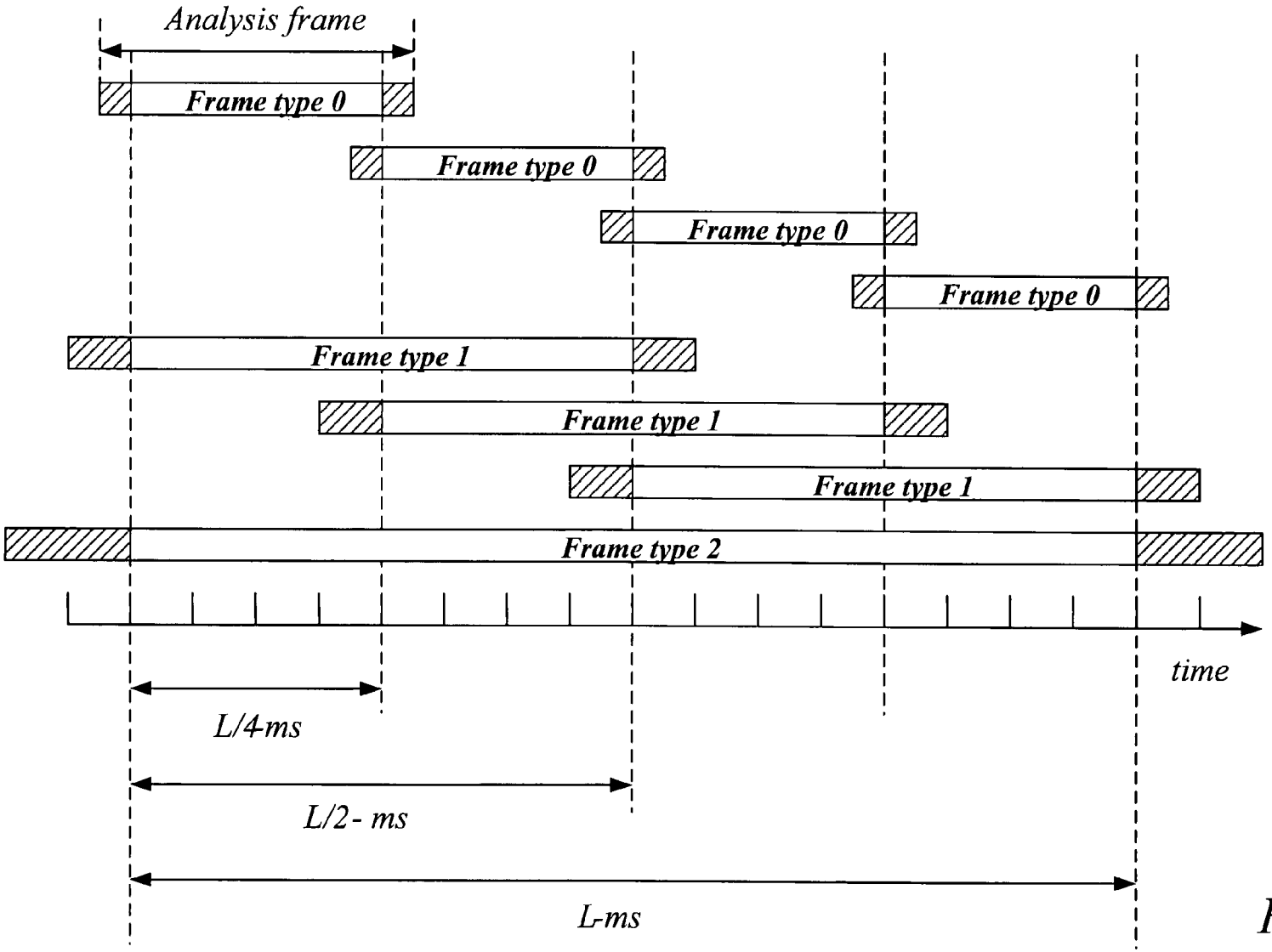
FIG. 6 is a schematic timing chart of different frame divisions in a master frame.
Figure 7:
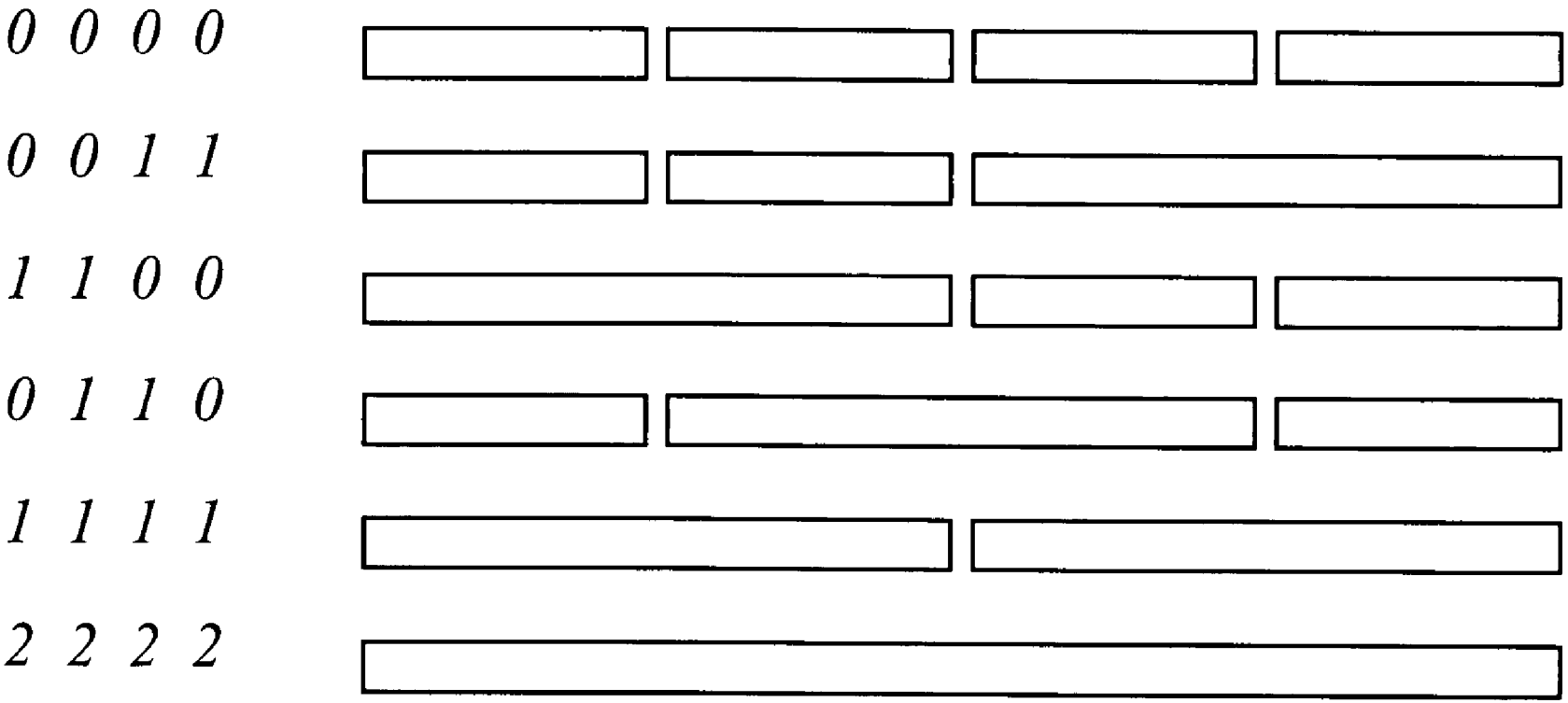
FIG. 7 illustrates different frame configurations according to an exemplary non-limiting embodiment of the invention.

Frame divisions may have different sizes but the sum of all frames divisions cover the whole length of the master-frame. Considering a master-frame of length L ms, an example of possible frame divisions is illustrated in FIG. 6, and an example of possible frame configurations is illustrated in FIG. 7.

As previously mentioned, the idea is to select a combination of encoding scheme with associated frame division configuration, as well filter length/dimension for each sub-frame, so as to optimize a fidelity measure representative of the performance of the considered encoding process or encoding scheme over an entire encoding frame (master-frame).

Preferably, all possible combinations are tested and the encoding scheme with an associated set of sub-frames and filter lengths that gives the best objective quality, e.g. signal-to-noise ratio or a weighted signal-to-noise ratio, is selected.

The possibility to adjust the filter length for each sub-frame provides an added degree of freedom, and generally results in improved performance. An advantage of using this scheme is that the dynamics of the stereo or multi-channel image are well represented.

With a higher degree of freedom, it is possible to find a truly optimal selection. However, the amount of control information to be transferred to the decoding side increases. For the specific problem of reducing the signaling requirements during transmission from the encoding side to the decoding side, each sub-frame of a certain length is preferably associated with a predefined filter length. Usually long filters are assigned to long frames and short filters to short frames. Anyway, the predetermined criterion thus includes the requirement that the filter length, for each sub frame, is selected in dependence on the length of the sub-frame so that an indication of frame division configuration of an encoding frame into a set of sub-frames at the same time provides an indication of selected filter dimension for each sub-frame. In this way, the required signaling to the decoding side may be reduced.

In a preferred embodiment of the invention, the predetermined criterion is based on optimization of a measure representative of the performance of said second encoding process over an entire encoding frame under the requirement that the filter length, for each sub frame, is controlled by the length of the sub-frame.

If the first encoding process uses so-called variable frame length processing with a frame division configuration of an overall encoding frame into a set of sub-frames, it may be useful to use the same frame division configuration also for the second encoding process. In this way, it is sufficient to signal information representative of the frame division configuration for only one of the encoding processes.

With reference to the particular example of FIGS. 6 and 7, possible frame configurations are listed in the following table:

| | | | |
|---|---|---|---|
| 0, | 0, | 0, | 0 |
| 0, | 0, | 1, | 1 |
| 1, | 1, | 0, | 0 |
| 0, | 1, | 1, | 0 |
| 1, | 1, | 1, | 1 |
| 2, | 2, | 2, | 2 |

in the form ($m_1$, $m_2$, $m_3$, $m_4$) where $m_k$ denotes the frame type selected for the kth (sub)frame of length L/4 ms inside the master-frame such that for example:

$m_k$=0 for L/4 frame with filter length P, $m_k$=1 for L/2-ms frame with filter length 2×P, $m_k$=2 for L-ms super-frame with filter length 4×P.

By way of example, the configuration (0, 0, 1, 1) indicates that the L–ms master-frame is divided into two L/4-ms (sub) frames with filter length P, followed by an L/2-ms (sub)frame with filter length 2×P. Similarly, the configuration (2, 2, 2, 2) indicates that the L-ms frame is used with filter length 4×P. This means that frame division configuration as well as filter length information are simultaneously indicated by the information ($m_1$, $m_2$, $m_3$, $m_4$).

The optimal configuration is selected, for example, based on the MSE or equivalently maximum SNR. For instance, if the configuration (0,0,1,1) is used, then the total number of filters is 3:2 filters of length P and 1 of length 2×P.

The frame configuration, with its corresponding filters and their respective lengths, that leads to the best performance (e.g. measured by SNR or MSE) is usually selected.

The filters computation, prior to frame selection, may be either open-loop or closed-loop by including the filters quantization stages.

The advantage of using this scheme is that with this procedure, the dynamics of the stereo or multi-channel image are well represented.

Because of the variable frame length processing that is involved, the analysis windows overlap in the encoder can be of different lengths. In the decoder, it is therefore essential for the synthesis of the channel signals to window accordingly and to overlap-add different signal lengths.

It is often the case that for stationary signals the stereo image is quite stable and the estimated channel filters are quite stationary.

Figure 8:
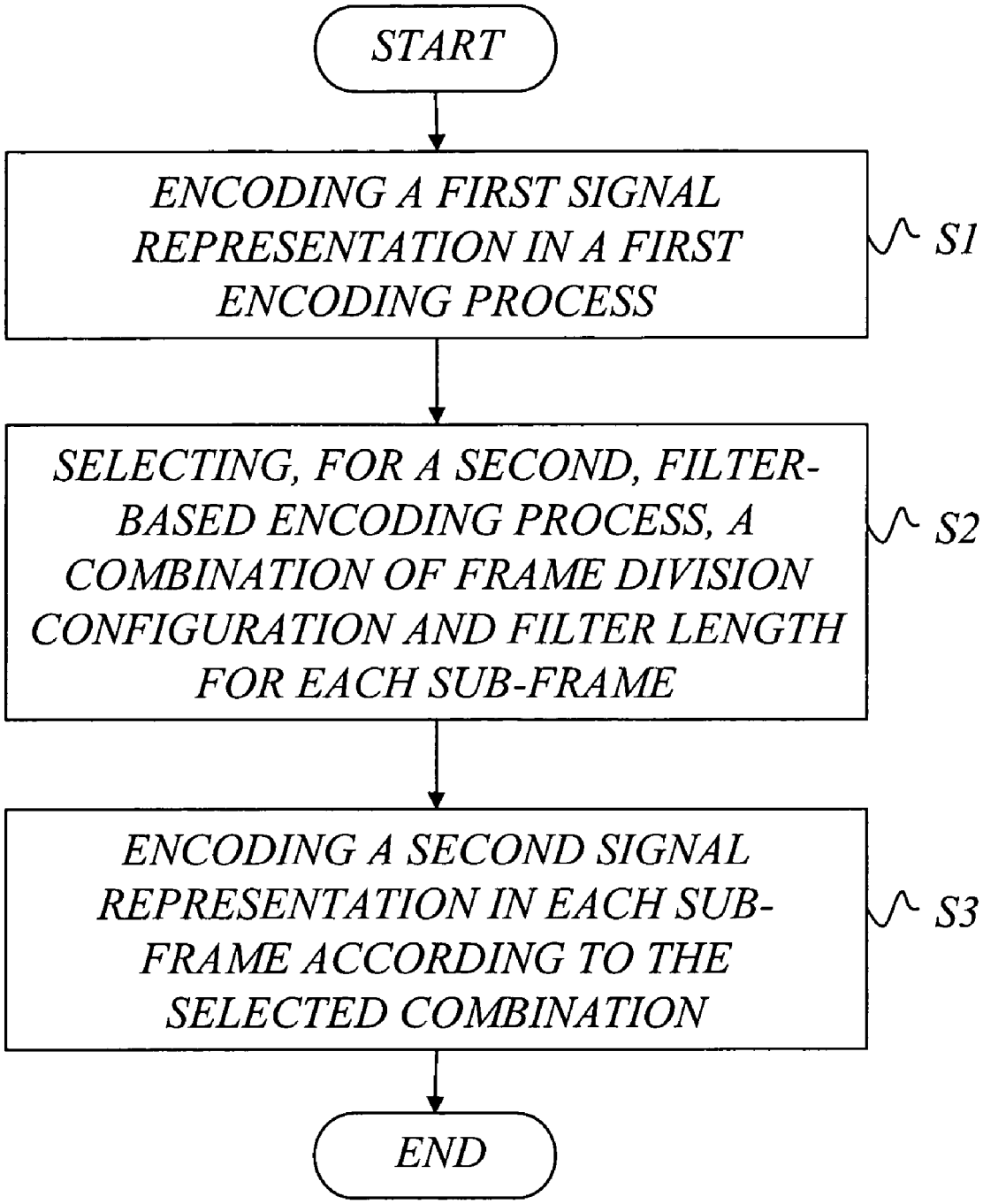
FIG. 8 is a schematic flow diagram setting forth a basic multi-channel encoding procedure according to a preferred non-limiting embodiment of the invention.

FIG. 8 is a schematic flow diagram setting forth a basic multi-channel encoding procedure according to a preferred embodiment of the invention. In step S1, a first signal representation of one or more audio channels is encoded in a first encoding process. In step S2, a combination of frame division configuration and filter length for each sub-frame is selected for a second, filter-based encoding process. This selection procedure is performed according to a predetermined criterion, which may be based on optimization of a performance measure. In step S3, the second signal representation is encoded in each sub-frame of the overall encoding frame according to the selected combination.

The overall decoding process is generally quite straight forward and basically involves reading the incoming data stream, interpreting data using transmitted control information, inverse quantization and final reconstruction of the multi-channel audio signal. More specifically, in response to first signal reconstruction data, an encoded first signal representation of at least one of said multiple channels is decoded in a first decoding process. In response to second signal reconstruction data, an encoded second signal representation of at least one of said multiple channels is decoded in a second decoding process. In at least the latter case, information representative of which frame division configuration of an overall encoding frame into a set of sub-frames, and filter length for each sub-frame, that have been used in a corresponding second encoding process is received on the decoding side. Based on this control information it is then determined how to interpret the second signal reconstruction data in the second decoding process.

In a particularly preferred embodiment, the control information includes data that while indicating frame division configuration of an encoding frame into a set of sub-frames at the same time provides an indication of selected filter dimension for each sub-frame.

For a more detailed understanding, this non-limiting aspect of the invention will now mainly be described with reference to exemplary embodiments of stereophonic (two-channel) encoding and decoding. However, it should be kept in mind that the invention is generally applicable to multiple channels. Examples include but are not limited to encoding/decoding 5.1 (front left, front centre, front right, rear left and rear right and subwoofer) or 2.1 (left, right and center subwoofer) multi-channel sound.

It should also be understood that aspects of the invention can be applied to a side encoder, a main encoder or both a side encoder and a main encoder. It is in fact possible to apply the invention to an arbitrary subset of the N encoders in the overall multi-channel encoder apparatus.

Figure 9:
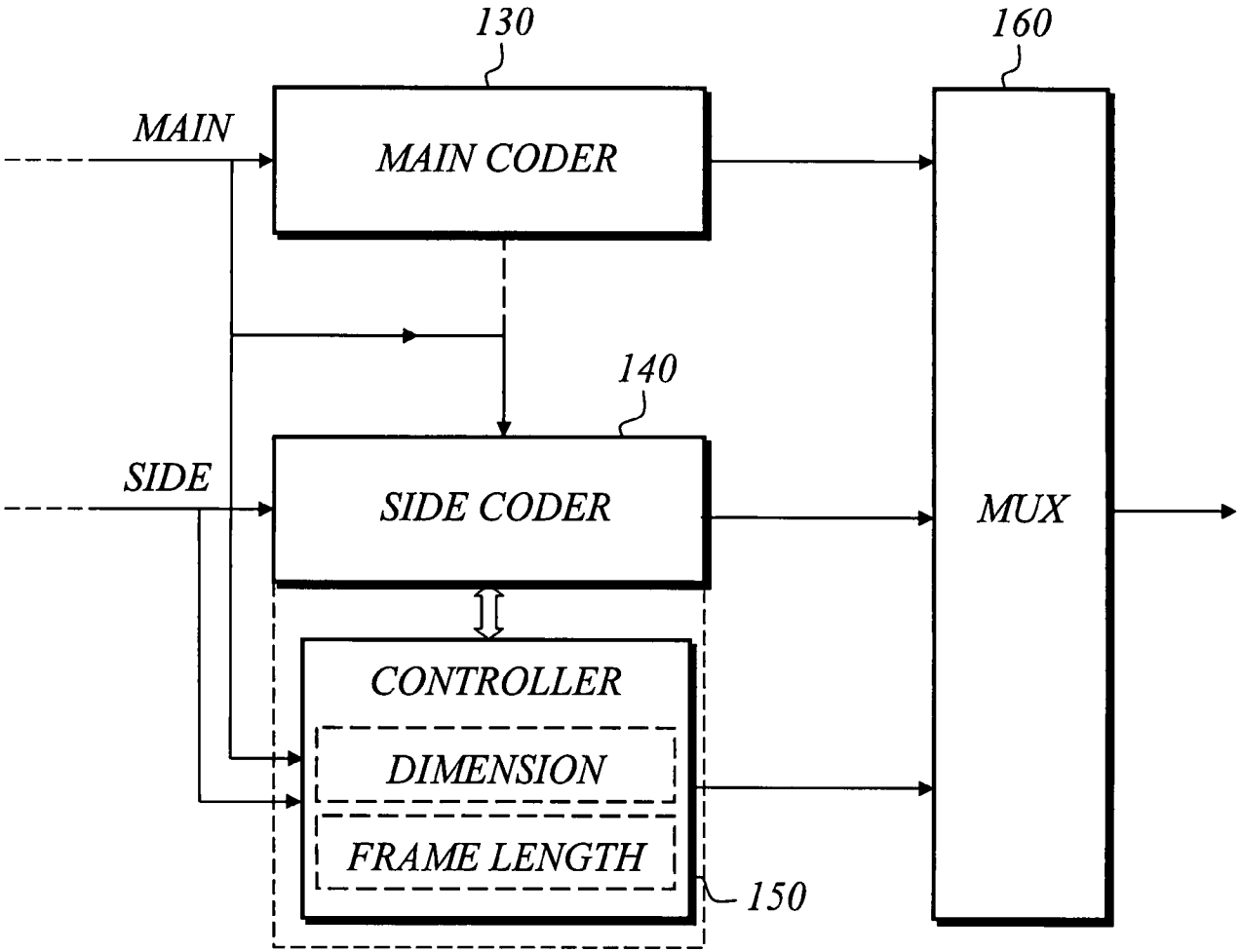
FIG. 9 is a schematic block diagram illustrating relevant parts of an encoder according to an exemplary preferred non-limiting embodiment of the invention.

FIG. 9 is a schematic block diagram illustrating relevant parts of an encoder according to an exemplary preferred embodiment of the invention. The encoder basically comprises a first (main) encoder 130 for encoding a first (main) signal such as a typical mono signal, a second (auxiliary/side) encoder 140 for (auxiliary/side) signal encoding, a controller 150 and an optional multiplexor unit 160. The controller 150 is adapted to receive the main signal representation and the side signal representation and configured to perform the necessary computations to optimally or at least sub-optimally (under given restrictions) select a combination of frame division configuration of an overall encoding frame and filter length for each sub-frame. The controller 150 may be a "separate" controller or integrated into the side encoder 140. The encoding parameters and information representative of frame division and filter lengths are preferably multiplexed into a single transmission or storage signal in the multiplexor unit 160.

Figure 10:
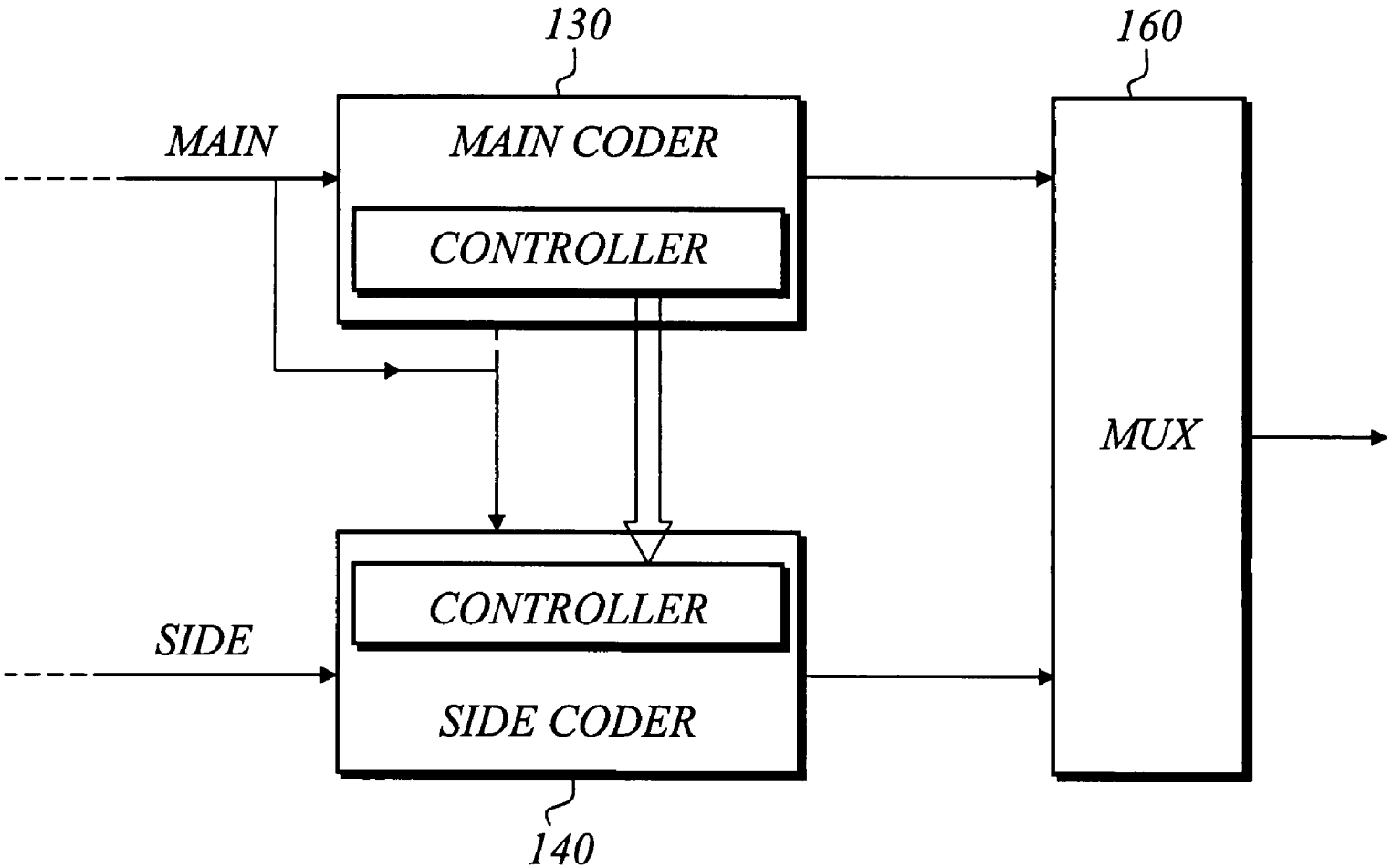
FIG. 10 is a schematic block diagram illustrating relevant parts of an encoder according to an exemplary alternative non-limiting embodiment of the invention.

FIG. 10 is a schematic block diagram illustrating relevant parts of an encoder according to an exemplary alternative embodiment of the invention. In this particular realization, each sub-encoder within the overall stereo or multi-channel encoder has its own integrated controller. The controller within the side encoder is preferably configured to select frame division configuration and filter lengths for the side encoding process. This selection is preferably based on optimization of the encoder performance and/or the requirement that the filter length, for each sub frame, is selected in dependence on the length of the sub-frame.

For example, if the main encoder uses so-called variable frame length processing with a frame division configuration of an overall encoding frame into a set of sub-frames, it may be useful to use the same frame division configuration also for the side encoder. In this way, it is sufficient to transmit information representative of the frame division configuration to the decoding side for only one of the encoders. The main encoder controller then typically signals which frame division configuration it will use for an overall encoding frame to the side encoder controller, which in turn uses the same frame division. There are still two alternatives for the side encoding process, namely 1) letting the determined frame division directly control the filter lengths, or 2) freely selecting filter lengths for the determined frame division. The latter alternative naturally gives a higher degree of freedom, but may require more signaling. The former alternative does not require any further signaling. It is sufficient that the main encoder controller transmits information on the selected frame division configuration to the decoding side, which may then use this information to interpret transmitted signal reconstruction data to thereby correctly decode encoded the multi-channel audio information. However, the former alternative may be sub-optimal, since the choice of filter lengths is somewhat restricted.

Figure 11:
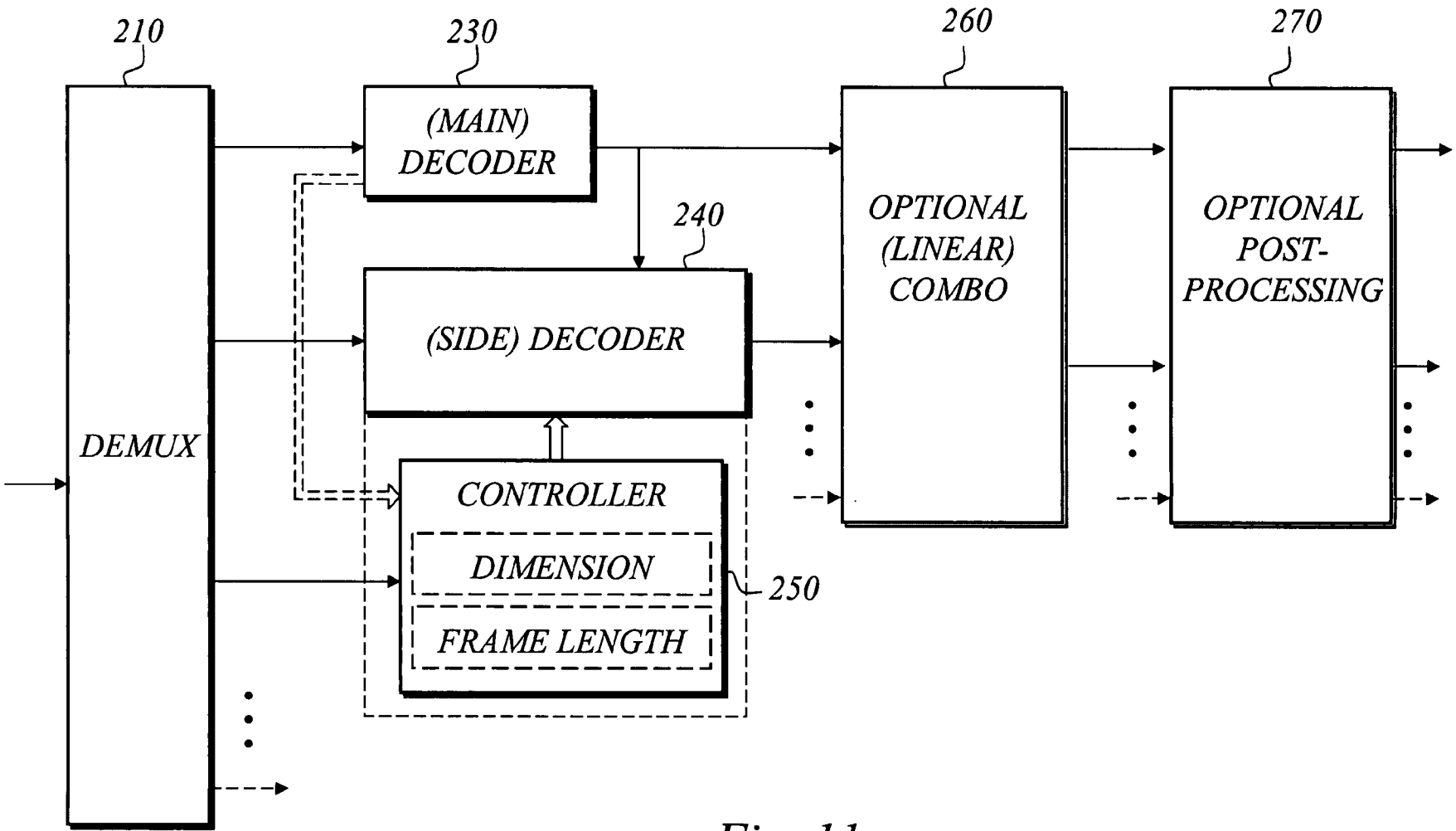
FIG. 11 illustrates a decoder according to preferred non-limiting; exemplary embodiment of the invention.

FIG. 11 is a schematic block diagram illustrating relevant parts of a decoder according to an exemplary preferred embodiment of the invention. The decoder basically comprises an optional demultiplexor unit 210, a first (main) decoder 230, a second (auxiliary/side) decoder 240, a controller 250, an optional signal combination unit 260 and an optional post-processing unit 270. The demultiplexor 210 preferably separates the incoming reconstruction information such as first (main) signal reconstruction data, second (auxiliary/side) signal reconstruction data and control information such as information on frame division configuration and filter lengths. The first (main) decoder 230 "reconstructs" the first (main) signal in response to the first (main) signal reconstruction data, usually provided in the form of first (main) signal representing encoding parameters. The second (auxiliary/side) decoder 240 preferably "reconstructs" the second (side) signal in response to quantized filter coefficients and the reconstructed first signal representation. The second (side) decoder 240 is also controlled by the controller 250, which may or may not be integrated into the side decoder. The controller receives information on frame division configuration and filter lengths from the encoding side, and controls the side decoder 240 accordingly.

If the main encoder uses so-called variable frame length processing with a frame division configuration, and the main encoder controller transmits information on the selected frame division configuration to the decoding side, it may as an option be possible (as indicated by the dashed line) for the main decoder 230 to signal this information to the controller 250 for use when controlling the side decoder 240.

For a more thorough understanding, a non-limiting aspect will now be described in more detail with reference to various exemplary embodiments based on parametric coding principles such as inter-channel prediction.

Parametric Coding Using Inter-Channel Prediction

In general, inter-channel prediction (ICP) techniques utilize the inherent inter-channel correlation between the channels. In stereo coding, channels are usually represented by the left and the right signals l(n), r(n), an equivalent representation is the mono signal m(n) (a special case of the main signal) and the side signal s(n). Both representations are equivalent and are normally related by the traditional matrix operation:

$$\begin{bmatrix} m(n) \\ s(n) \end{bmatrix} = \frac{1}{2}\begin{bmatrix} 1 & 1 \\ 1 & -1 \end{bmatrix}\begin{bmatrix} l(n) \\ r(n) \end{bmatrix} \tag{1}$$

The ICP technique aims to represent the side signal s(n) by an estimate $\hat{s}(n)$, which is obtained by filtering the mono signal m(n) through a time-varying FIR filter H(z) having N filter coefficients $h_t(i)$:

$$\hat{s}(n) = \sum_{i=0}^{N-1} h_t(i)m(n-i) \tag{2}$$

It should be noted that the same approach could be applied directly on the left and right channels.

The ICP filter derived at the encoder may for example be estimated by minimizing the mean squared error (MSE), or a related performance measure, for instance psycho-acoustically weighted mean square error, of the side signal prediction error e(n). The MSE is typically given by:

$$\xi(h) = \sum_{n=0}^{L-1} MSE(n, h) = \sum_{n=0}^{L-1}\left(s(n) - \sum_{i=0}^{N-1} h(i)m(n-i)\right)^2 \tag{3}$$

where L is the frame size and N is the length/order/dimension of the ICP filter. Simply speaking, the performance of the ICP filter, thus the magnitude of the MSE, is the main factor determining the final stereo separation. Since the side signal describes the differences between the left and right channels, accurate side signal reconstruction is essential to ensure a wide enough stereo image.

The optimal filter coefficients are found by minimizing the MSE of the prediction error over all samples and are given by:

$$h_{op}^T R = r \Rightarrow h_{opt} = R^{-1} r \tag{4}$$

In (4) the correlations vector r and the covariance matrix R are defined as:

$$r = Ms$$

$$R = MM^T \tag{5}$$

where $$s = [s(0) \;\; s(1) \;\; \ldots \;\; s(L-1)]^T, \tag{6}$$

$$M\begin{bmatrix} m(0) & m(1) & \ldots & m(L-1) \\ m(-1) & m(0) & \ldots & m(L-2) \\ \vdots & \ddots & \ddots & \vdots \\ m(-N+1) & \ldots & \ldots & m(L-N) \end{bmatrix}$$

Inserting (5) into (3) one gets a simplified algebraic expression for the Minimum MSE (MMSE) of the (unquantized) ICP filter:

$$MMSE = MSE(h_{opt}) = P_{ss} - r^T R^{-1} r \tag{7}$$

where $P_{ss}$ is the power of the side signal, also expressed as $s^T s$.

Inserting $r = Rh_{opt}$ into (7) yields:

$$MMSE = P_{ss} - r^T R^{-1} R h_{opt} = P_{ss} - r^T h_{opt} \tag{8}$$

LDLT factorization [9] on R gives us the equation system:

$$\underbrace{LDL^T h}_{z} = r \tag{9}$$

Where we first solve z in and iterative fashion:

$$\begin{bmatrix} 1 & 0 & \ldots & 0 \\ l_{21} & 1 & \ddots & \vdots \\ \vdots & \ddots & \ddots & 0 \\ l_{N1} & \ldots & l_{NN-1} & 1 \end{bmatrix}\begin{bmatrix} z_1 \\ z_2 \\ \vdots \\ z_N \end{bmatrix} = \begin{bmatrix} r_1 \\ r_2 \\ \vdots \\ r_N \end{bmatrix} \Rightarrow z_i = r_i - \sum_{j=1}^{i-1} l_{ij} z_j \tag{10}$$

Now we introduce a new vector $q = L^T h$. Since the matrix D only has non-zero values in the diagonal, finding q is straightforward:

$$Dq = z \Rightarrow q_i = \frac{z_i}{d_i}, \quad i = 1, 2, \ldots, N \tag{11}$$

The sought filter vector h can now be calculated iteratively in the same way as (10):

$$\begin{bmatrix} 1 & l_{12} & \dots & l_{1N} \\ 0 & 1 & \ddots & \vdots \\ \vdots & \ddots & \ddots & l_{N-1N} \\ 0 & \dots & 0 & 1 \end{bmatrix} \begin{bmatrix} h_1 \\ h_2 \\ \vdots \\ h_N \end{bmatrix} = \begin{bmatrix} q_1 \\ q_2 \\ \vdots \\ q_N \end{bmatrix} \Rightarrow h_i = q_i - \sum_{j=1}^{N-i} l_{i(i+j)} h_{(i+j)}, \quad i = 1, 2, \dots, N \tag{12}$$

Besides the computational savings compared to regular matrix inversion, this solution offers the possibility of efficiently calculating the filter coefficients corresponding to different dimensions n (filter lengths):

$$H=\{h_{opt}^{(n)}\}_{n=1}^{N} \tag{13}$$

The optimal ICP (FIR) filter coefficients $h_{opt}$ may be estimated, quantized and sent to the decoder on a frame-by-frame basis.

In general, the filter coefficients are treated as vectors, which are efficiently quantized using vector quantization (VQ). The quantization of the filter coefficients is one of the most important aspects of the ICP coding procedure. As will be seen, the quantization noise introduced on the filter coefficients can be directly related to the loss in MSE.

The MMSE has previously been defined as:

$$MMSE=s^Ts-r^Th_{opt}=s^Ts-2h_{opt}^Tr+h_{opt}^TRh_{opt} \tag{14}$$

Quantizing $h_{opt}$ introduces a quantization error e: $\hat{h}=h_{opt}+e$. The new MSE can now be written as:

$$\begin{aligned} MSE(h_{opt}+e) &= s^Ts - 2(h_{opt}+e)^Tr + (h_{opt}+e)^TR(h_{opt}+e) \\ &= MMSE + e^TRh_{opt} + e^TRe + h_{opt}^TRe - 2e^Tr \\ &= MMSE + e^TRe + 2e^TRh_{opt} - 2e^Tr \end{aligned} \tag{15}$$

Since $Rh_{opt}=r$, the last two terms in (15) cancel out and the MSE of the quantized filter becomes:

$$MSE(\hat{h})=s^Ts-r^Th_{opt}+e^TRe \tag{16}$$

What this means is that in order to have any prediction gain at all the quantization error term has to be lower than the prediction term, i.e. $r^Th_{opt}>e^TRe$.

In general, quantizing a longer vector yields a larger quantization error. Remembering that MSE of the quantized ICP filter is defined as:

$$MSE(\hat{h}^{(n)},n)=s^Ts-(r^{(n)})^Th_{opt}^{(n)}+(e^{(n)})^TR^{(n)}e^{(n)} \tag{17}$$

it can be seen that the obtained MSE is a trade-off between the selected filter dimension n and the imposed quantization error. Consider a scheme where the filter dimension for each frame is selected such that (17) is always minimum, given a fixed number of bits:

$$n^* = \underset{n\in[1,n_{max}]}{\operatorname{argmin}} \{MSE\ (\hat{h}^{(n)}, n)\} \tag{18}$$

In accordance with an exemplary embodiment of the invention it is desirable to select frame division configuration and filter lengths thereof according to:

$$(n_{opt}, m_{opt}) = \underset{\substack{n\in[1,n_{max}] \\ m\in M}}{\operatorname{argmin}} \{\theta\ (\hat{h}^{(n)}, n, m)\} \tag{19}$$

where:

$$\theta\ (\hat{h}^{(n)}, n, m) = \sum_{\substack{m\in M \\ n\in N}} \sum_{t=0}^{m-1} \left( s(t) - \sum_{i=0}^{n-1} \hat{h}_n(i) m(t-i) \right)^2 \tag{20}$$

and where N is the collection of possible filter dimension vectors, and M is the collection of possible frame length configurations. It should be understood that formula (20) is merely an example, and that a wide range of variations exists.

The embodiments described above are merely given as examples, and it should be understood that the present invention is not limited thereto. Further modifications, changes and improvements which retain the basic underlying principles disclosed and claimed herein are within the scope of the invention.

REFERENCES

[1] U.S. Pat. No. 5,285,498 by Johnston.

[2] European Patent No. 0,497,413 by Veldhuis et al.

[3] C. Faller et al., "Binaural cue coding applied to stereo and multi-channel audio compression", 112$^{th}$ *AES convention*, May 2002, Munich, Germany.

[4] U.S. Pat. No. 5,434,948 by Holt et al.

[5] S-S. Kuo, J. D. Johnston, "A study why cross channel prediction is not applicable to perceptual audio coding", *IEEE Signal Processing Lett.*, vol. 8, pp. 245-247.

[6] B. Edler, C. Faller and G. Schuller, "Perceptual audio coding using a time-varying linear pre- and post-filter", in *AES Convention*, Los Angeles, Calif., September 2000.

[7] Bernd Edler and Gerald Schuller, "Audio coding using a psychoacoustical pre- and post-filter", *ICASSP*-2000 *Conference Record,* 2000.

[8] Dieter Bauer and Dieter Seitzer, "Statistical properties of high-quality stereo signals in the time domain", *IEEE International Conf. on Acoustics, Speech, and Signal Processing*, vol. 3, pp. 2045-2048, May 1989.

[9] Gene H. Golub and Charles F. van Loan, "*Matrix Computations", second edition*, chapter 4, pages 137-138, The John Hopkins University Press, 1989.

The invention claimed is:

1. In an encoder arranged to encode a multi-channel audio signal, said encoder including a first main encoder, a second auxiliary encoder and a controller, a method of encoding said multi-channel audio signal, comprising:

encoding, using said first main encoder, a first signal representation of at least one of said multiple channels in a first main encoding process; and encoding, using said second auxiliary encoder, a second signal representation of at least one of said multiple channels in a second, filter-based auxiliary encoding process, characterized by:

selecting, using said controller, for said second, filter-based auxiliary encoding process, a combination of i) frame division configuration of an overall encoding frame into a set of sub-frames, and ii) filter length for each sub-frame, according to a predetermined criterion, wherein said set of sub-frames includes sub-frames having different sizes and the filter length, for each sub frame, is selected in dependence on the length of the sub-frame; and encoding, using said second auxiliary encoder, for said overall frame, said second signal representation in each of the sub-frames of the selected set of sub-frames in accordance with the selected combination; and generating, using said controller, output data representative of the selected frame division configuration and filter length for each sub-frame of the selected frame division configuration, wherein said output data includes data that while indicating the selected frame division configuration of an encoding frame into said set of sub-frames at the same time provides an indication of the selected filter length for each sub-frame.

2. The encoding method of claim 1, wherein said predetermined criterion is based on optimization of a measure representative of a performance of said second, filter-based auxiliary encoding process over an entire encoding frame.

3. The encoding method of claim 1, wherein said predetermined criterion includes the requirement that the filter length, for each sub frame, is selected in dependence on the length of the sub-frame so that an indication of frame division configuration of an encoding frame into a set of sub-frames at the same time provides an indication of selected filter dimension for each sub-frame to thereby reduce the required signaling to the decoding side.

4. The encoding method of claim 3, wherein said predetermined criterion is based on optimization of a measure representative of the performance of said second, filter-based auxiliary encoding process over an entire encoding frame under the requirement that the filter length, for each sub frame, is controlled by the length of the sub-frame.

5. The encoding method of claim 1, wherein said first main encoding process is also based on a frame division configuration of an overall encoding frame into a set of sub-frames, and said predetermined criterion includes the requirement that the frame division configuration of an overall encoding frame into a set of sub-frames for said second, filter-based auxiliary encoding process is selected to be the same as the frame division configuration of the first encoding process.

6. The encoding method of claim 1, further comprising generating, using said controller, output data representative of the selected frame division configuration, and filter length for each sub-frame of the selected frame division configuration.

7. The encoding method of claim 1, wherein said steps of selecting and encoding are performed on a frame-by-frame basis.

8. The encoding method of claim 1, wherein said step of selecting a combination is performed based on inter-channel correlation characteristics of said multi-channel audio signal.

9. The encoding method of claim 1, wherein said second, filter-based auxiliary encoding process includes an adaptive inter-channel prediction for prediction of said second signal representation based on the first signal representation and the second signal representation.

10. The encoding method of claim 9, wherein said step of selecting said combination is performed based on an estimated performance of said second, filter-based auxiliary encoding process.

11. The encoding method of claim 1, wherein said step of selecting said combination is performed for both said first main encoding process and said second, filter-based auxiliary encoding process.

12. An apparatus arranged to encode a multi-channel audio signal, comprising:

a first main encoder configured to encode a first signal representation of at least one of said multiple channels in a first main encoding process;

a second, filter-based auxiliary encoder configured to encode a second signal representation of at least one of said multiple channels in a second, filter-based auxiliary encoding process, characterized by:

a controller being configured to select, for said second, filter-based auxiliary encoder, a combination of i) frame division configuration of an overall encoding frame into a set of sub-frames, and ii) filter length for each sub-frame, according to a predetermined criterion, wherein said controller is configured to select a frame division configuration including sub-frames having different sizes and to select the filter length, for each sub-frame, in dependence on the length of the sub-frame; and said second, filter-based auxiliary encoder being configured to encode, for said overall frame, said second signal representation in each of the sub-frames of the selected set of sub-frames in accordance with the selected combination; and said controller also configured to generate output data representative of the selected frame division configuration and filter length for each sub-frame of the selected frame division configuration, wherein said output data includes data that while indicating the selected frame division configuration of an encoding frame into said set of sub-frames at the same time provides an indication of the selected filter length for each sub-frame.

13. The apparatus of claim 12, wherein said controller is configured to operate based on optimization of a measure representative of the performance of said second, filter-based auxiliary encoding process over an entire encoding frame.

14. The apparatus of claim 12, wherein said controller is configured to operate under the requirement that the filter length, for each sub frame, is selected in dependence on the length of the sub-frame so that an indication of frame division configuration of an encoding frame into a set of sub-frames at the same time provides an indication of selected filter dimension for each sub-frame to thereby reduce the required signaling to the decoding side.

15. The apparatus of claim 14, wherein said controller is configured to operate based on optimization of a measure representative of the performance of said second, filter-based auxiliary encoding process over an entire encoding frame under the requirement that the filter length, for each sub frame, is controlled by the length of the sub-frame.

16. The apparatus of claim 12, wherein said first main encoder also operates based on a frame division configuration of an overall encoding frame into a set of sub-frames, and said controller is configured to operate under the requirement that the frame division configuration of an overall encoding frame into a set of sub-frames for said second, filter-based auxiliary encoding process is selected to be the same as the frame division configuration of the first main encoding process.

17. The apparatus of claim 12, wherein said controller is configured to generate output data representative of the selected frame division configuration, and filter length for each sub-frame of the selected frame division configuration.

18. The apparatus of claim 12, wherein said controller and said second, filter-based auxiliary encoder for encoding are operable on a frame-by-frame basis.

19. The apparatus of claim 12, wherein said controller is responsive to inter-channel correlation characteristics of said multi-channel audio signal to select said combination.

20. The apparatus of claim 12, wherein said second, filter-based auxiliary encoder includes an adaptive inter-channel prediction filter for prediction of said second signal representation based on the first signal representation and the second signal representation.

21. The apparatus of claim 20, wherein said controller is responsive to estimated performance of said second, filter-based auxiliary encoding process to select said combination.

22. The apparatus of claim 12, wherein said controller is configured to perform said selection of said combination of frame division configuration and filter length for each sub-frame for both said first main encoder and said second, filter-based auxiliary encoder.

23. In a decoder arranged to decode an encoded multi-channel audio signal, said decoder including a first main decoder, a second auxiliary decoder and a controller, a method of decoding said encoded multi-channel audio signal, comprising:

decoding, using said first main decoder, in response to first signal reconstruction data, an encoded first signal representation of at least one of said multiple channels in a first main decoding process;

decoding, using said second auxiliary decoder, in response to second signal reconstruction data, an encoded second signal representation of at least one of said multiple channels in a second auxiliary decoding process, characterized by:

receiving, using said controller, information representative of which frame division configuration of an overall encoding frame into a set of sub-frames, and filter length for each sub-frame, that have been used in a corresponding second auxiliary encoding process, wherein said set of sub-frames includes sub-frames having different sizes and said information includes data that while indicating the selected frame division configuration of an encoding frame into said set of sub-frames at the same time provides an indication of the selected filter length for each sub-frame; and determining, using said controller, based on said information, how to interpret said second signal reconstruction data in said second auxiliary decoding process.

24. The decoding method of claim 23, wherein said information includes data that while indicating frame division configuration of an encoding frame into a set of sub-frames at the same time provides an indication of selected filter dimension for each sub-frame.

25. An apparatus for decoding an encoded multi-channel audio signal comprising:

a first main decoder configured to decode, in response to first signal reconstruction data, an encoded first signal representation of at least one of said multiple channels in a first main decoding process;

a second auxiliary decoder configured to decode, in response to second signal reconstruction data, an encoded second signal representation of at least one of said multiple channels in a second auxiliary decoding process, characterized by:

a controller configured to receive information representative of which frame division configuration of an overall encoding frame into a set of sub-frames, and filter length for each sub-frame, that have been used in a corresponding second auxiliary encoding process, wherein said set of sub-frames includes sub-frames having different sizes and said information includes data that while indicating the selected frame division configuration of an encoding frame into said set of sub-frames at the same time provides an indication of the selected filter length for each sub-frame; and said controller also configured to determined, based on said information, how to interpret said second signal reconstruction data in said second auxiliary decoding process.

26. The decoding apparatus of claim 25, wherein said information includes data that while indicating frame division configuration of an encoding frame into a set of sub-frames at the same time provides an indication of selected filter dimension for each sub-frame.

27. An audio transmission system, comprising:

an encoding apparatus according to claim 12; and a decoding apparatus, said decoding apparatus comprising:

a first main decoder configured to decode, in response to first signal reconstruction data, an encoded first signal representation of at least one of said multiple channels in a first main decoding process;

a second auxiliary decoder configured to decode, in response to second signal reconstruction data, an encoded second signal representation of at least one of said multiple channels in a second auxiliary decoding process, characterized by:

a controller configured to receive information representative of which frame division configuration of an overall encoding frame into a set of sub-frames, and filter length for each sub-frame, that have been used in a corresponding second auxiliary encoding process, wherein said set of sub-frames includes sub-frames having different sizes and said information includes data that while indicating the selected frame division configuration of an encoding frame into said set of sub-frames at the same time provides an indication of the selected filter length for each sub-frame; and said controller also configured to determined, based on said information, how to interpret said second signal reconstruction data in said second auxiliary decoding process.

* * * * *